US005197920A

United States Patent [19]

Ganse

[11] Patent Number: 5,197,920

[45] Date of Patent: Mar. 30, 1993

[54] ELEMENT FOR USER IN A HEATING AND AIR CONDITIONING DUCTWORK SYSTEM

[76] Inventor: Thomas Ganse, 1025 Oakdale La., Lemoore, Calif. 93245

[21] Appl. No.: 764,230

[22] Filed: Sep. 23, 1991

[51] Int. Cl.[5] ..... F24F 13/06

[52] U.S. Cl. ..... 454/228; 454/261; 454/292; 454/306

[58] Field of Search ..... 454/228, 261, 262, 284, 454/292, 244, 305, 306, 309, 322

[56] References Cited

U.S. PATENT DOCUMENTS

| | | | |
|---|---|---|---|
| 3,005,397 | 10/1961 | Kristiansen | 454/284 |
| 3,726,202 | 4/1973 | Ahlberg | 454/228 |
| 4,700,550 | 10/1987 | Rhodes . | |
| 4,860,548 | 8/1989 | Ryham . | |
| 4,864,830 | 9/1989 | Ryham . | |

FOREIGN PATENT DOCUMENTS

| | | | |
|---|---|---|---|
| 620197 | 10/1935 | Fed. Rep. of Germany | 454/261 |
| 2149173 | 4/1972 | Fed. Rep. of Germany | 454/228 |
| 15335 | 11/1884 | United Kingdom | 454/322 |

*Primary Examiner*—Harold Joyce
*Attorney, Agent, or Firm*—Terry M. Gernstein

[57] ABSTRACT

An element for use in ductwork of a heating and air conditioning system includes a converging shape that causes pressure of the air flowing therethrough to decrease and which establishes a negative pressure between the surroundings of the element and the air flowing through the element. A plurality of vents are defined in the element whereby air from a room flows into the element to be mixed with conditioned air in the element before that conditioned air is exhausted into the room. The converging shape of the element causes pressure to vary according to a specific relationship, and each of the vents has a cross sectional area that varies according to the same relationship whereby adjacent vents have different cross sectional areas.

4 Claims, 3 Drawing Sheets

ELEMENT FOR USER IN A HEATING AND AIR CONDITIONING DUCTWORK SYSTEM

TECHNICAL FIELD OF THE INVENTION

The present invention relates to the general art of heating and air conditioning systems, and to the particular field of ductwork for use in heating and air conditioning systems.

BACKGROUND OF THE INVENTION

Most modern buildings and residential structures include some form of heating and air conditioning system. This system is intended to move conditioned air into and out of the rooms in the structure. Due to the costs associated with conditioning this air, much attention is directed to ensuring that such air movement is carried out in the most efficient manner possible.

Therefore, the building art has included air moving systems that have special controls, has several forms of temperature control means, or the like. In some cases, the conditioned air is not heated or cooled as much as would normally be called for to maintain costs as low as possible. Some areas of a building will be too hot or too cold as a result of this last-mentioned procedure for increasing air conditioning and heating efficiency.

While such methods may succeed in keeping building heating and cooling costs low, they are not entirely acceptable due to installation costs, maintenance costs, or simply because they do not provide an environment that is a comfortable as possible.

Still further, some of these systems may maintain a comfortable environment in one portion of a building, yet cause other areas of that same building to be too hot or too cold for comfort. The overall system may be so difficult to control that people in the individual areas of a building are not permitted to adjust the environment in their particular area because such adjustment may adversely affect the temperature in other areas of the same building.

Still further, some of these systems are expensive to install, and are not amenable to efficient installation into an already existing system.

Therefore, there is a need for a means for increasing the efficiency of a building heating or air conditioning system that will not be overly expensive to install, operate or control, yet will still permit the maintenance of a comfortable environment in each of several rooms of a building.

OBJECTS OF THE INVENTION

It is a main object of the present invention to provide means for increasing the efficiency of a building heating or air conditioning system.

It is another object of the present invention to provide means for increasing the efficiency of a building heating or air conditioning system that will not be overly expensive to install, operate or control.

It is another object of the present invention to provide means for increasing the efficiency of a building heating or air conditioning system that will not be overly expensive to install, operate or control, yet will still permit the maintenance of a comfortable environment in each of several rooms of a building.

SUMMARY OF THE INVENTION

These, and other, objects are achieved by a duct element for use in a building heating and air conditioning system that utilizes naturally occurring pressure gradients to circulate air within a room. The duct element is designed to take advantage of the pressure gradients in a manner that efficiently draws room air into the heating and air conditioning ductwork to mix that room air with the heated or cooled air in the ductwork prior to that heated or cooled air being exhausted into the room.

No special equipment is required to draw room air into the ductwork, yet that air is drawn into the ductwork in an efficient manner that can be easily adjusted by people in the room. However, such adjustment will not affect the heating or cooling of other areas of the building being serviced by the heating and air conditioning unit servicing the room being adjusted.

The duct element is simple to construct and install, and can be installed when the heating and air conditioning system is initially installed, or can be installed at a later time in a retrofit manner.

Specifically, the duct element is formed to include a converging shape adjacent to an exhaust section. This converging section includes a plurality of air intake vents defined therein. The duct element is fluidically connected to a source of treated air, such as a main fan or the like, and receives such treated air via an intake section. The treated air flows through the duct element and exits that duct element after passing through the converging section. Since the air flow through the duct work is subsonic, the pressure gradient in the duct element decreases toward the exhaust section thereof. This negative pressure gradient is combined with the natural turbulence of the air caused by the turning of that air in the duct element to produce a pressure inside the duct element that is less than the pressure of the air located outside the duct element. This pressure drop draws room air into the duct element via the intake vents. Such room air is mixed with the treated air flowing in the duct element and exhausted from the duct work with the treated air.

The duct element includes louvers that can be adjusted to control the amount of room air being drawn into the ductwork whereby the overall room temperature can be controlled by adjusting the louvers on the duct element. In this manner, the temperature of an individual room of a multi-room building can be controlled without unduly affecting the temperature of adjacent building areas. This control is easily effected, and the duct element can be easily installed.

More specifically, the sizes of each of the vents in the duct element are varied to match the variation of the adverse pressure gradient established in the converging duct element. This co-ordinated size variation permits each of the vents to be sized to most efficiently draw room air into the duct element whereby each duct vent will draw only that amount of air therethrough that is proper for that particular location on the duct element. In this manner, each vent will operate at maximum efficiency and will not interfere with adjacent duct element vents.

BRIEF DESCRIPTION OF THE DRAWINGS FIGURES

DETAILED DESCRIPTION OF THE PREFERRED EMBODIMENT OF THE INVENTION

Figure 1:
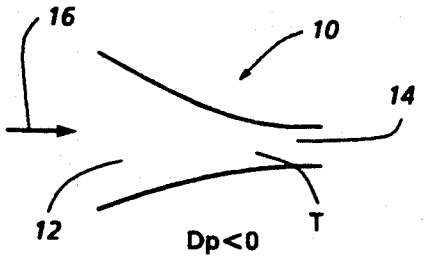
FIG. 1 is a sketch showing a converging air flow element.

Shown in FIG. 1 is a converging element 10 that extends from an intake area 12 to an exhaust area 14 in a downstream direction with respect to a flow direction 16 of a compressible fluid, such as air undergoing subsonic flow through the element 10. The exhaust section 14 is also the throat section T of the converging element. According to the laws and relationships of fluid mechanics, the pressure gradient of the fluid flowing through the element 10 can be described according to the following relationship:

$$(dA)/A=[(dp)/V^2][1-M^2];$$

where A=element area; p=pressure; V=air flow velocity; and M=the mach number.

As can be understood from this relationship, when the air flow is subsonic ($M<1$), the pressure gradient (dp) is negative in the downstream direction of the element, and this negative pressure gradient varies in accordance with a prescribed relationship with the variation of element flow area.

This co-ordinated pressure and area variation is used in the present invention to efficiently draw room air into a duct element for mixing with treated air being exhausted into the room from a heating and air conditioning system.

Figure 2:
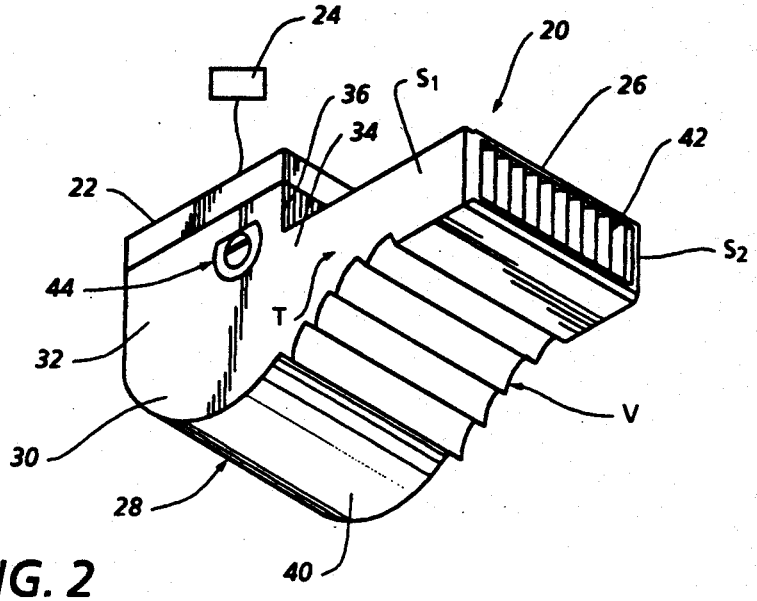
FIG. 2 is bottom perspective view of a duct element embodying the present invention.

A duct element 20 embodying the present invention is shown in FIG. 2. The duct element 20 includes an intake section 22 that is adapted to be fluidically connected to a source 24 of treated air, such as a furnace or air conditioning unit or system, or the like. The duct element 20 further includes an exhaust section 26 that is adapted to be fluidically connected to further ductwork (not shown) for directing the treated air received from the source 24 into a room or area of a building or other such structure.

The element 20 further includes a body 28 fluidically connecting the intake section 22 to the exhaust section 26. The body section includes an arcuate portion 30 that connects a linear entrance section 32 to a linear exit section 34. The linear exit section intersects the linear entrance section at a right angled corner 36 at a location spaced from the arcuate portion 30.

Figure 3:
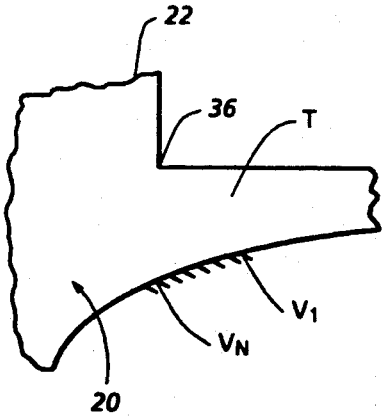
FIG. 3 is a sketch illustrating the vent size variation on the duct element as a function of position to account for the variation in pressure as air flows through a converging element under subsonic flow conditions.

As can be seen in FIG. 3, the curved shape of the body 28 in relation to the exhaust section thus approximates the converging shape shown in FIG. 1. Therefore, the above-presented pressure gradient/area relationship exists in the body 20. Air flowing through the body thus has a negative pressure gradient that is a function of the variation of the area of the body. Furthermore, as the air flows through the body 20, that air changes direction causing some turbulence which also affects the pressure gradient of the air in the body 20.

The pressure of the air inside the body 20 is less than the pressure of the air outside the body due to the negative pressure gradient established by the shape of the body 20. This pressure drop from ambient air to air inside the body is used in the duct element 20 to draw room air into the duct element 20. The drawn-in air is mixed with treated air received from unit or system 24 to control the temperature of the air in the room or area being serviced by the duct element 20.

Figure 4:
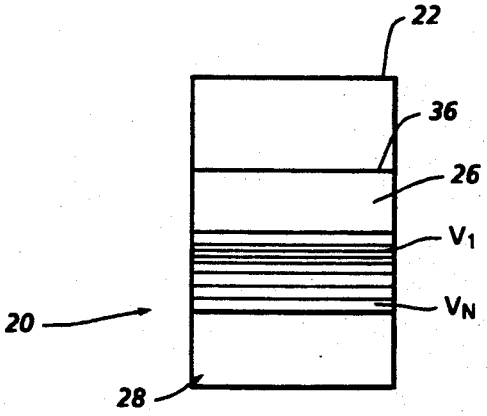
FIG. 4 is a front and bottom elevational view of the duct element of the present invention.

Therefore, the duct element 20 includes a plurality of air intake vents, such as vent V shown in FIG. 2. These vents are located in the arcuate body section between the location of maximum spacing from the intake section 22 and the exhaust section 26 to be in the converging portion of the body. The negative pressure gradient is established adjacent to this converging portion. As shown in FIGS. 3 and 4, the vents of the duct element 20 are sized and located to co-operate with this negative pressure gradient to efficiently draw air into the element 20. Each duct vent V is roughly rectangular and extends across the width of the duct as defined by sides S1 and S2 of the duct. Each vent has a width dimension extending across the width dimension of the duct and a length dimension extending in the flow direction of the air flowing through the duct from the intake 22 to the exhaust 26. Each vent has a cross-sectional area $A_v$ defined by the width dimension thereof and the length dimension thereof. Each vent cross-sectional area $A_v$ is adjusted in co-operation with the variation of dA in the above-presented relationship between dA and dp. Therefore, vent $V_1$ is located adjacent to the throat section T and has a cross-sectional area $A_{v1}$ that is less than the cross-sectional area $A_{v2}$ of vent $V_2$, and the cross-sectional area of adjacent vents increases according to the above-presented relationship between dA and dp to the maximum cross-sectional area $A_{VN}$ for vent $V_N$ located closely adjacent to the bottom 40 of the body 28, with the bottom 40 being located the maximum distance from the intake section 22.

For the sake of simplicity, the air flow through the element 20 is so slow that the quantity $(1-M^2)$ can be considered as being equal to "1" for purposes of sizing the vents. Therefore, in the most simple application of the present principles, the areas of the vents can be considered as co-operating with the area of the duct element adjacent to each vent according to a relationship as follows $$A_v=(A_{20})(K)$$

where K=a factor determined according to the density of the air and the velocity of the air flowing through the element 20 adjacent to the vent. However, in the most specific situation, the other factors in the converging flow relationship will be considered so the areas of the individual vents can be precisely adjusted according to the exact flow conditions existing adjacent thereto in the duct element Suitable curves can be generated and used in such design considerations.

The duct element 20 also includes louvers 42 and a damper 44 that can be adjusted to further control the air flow in the duct.

Figure 5:
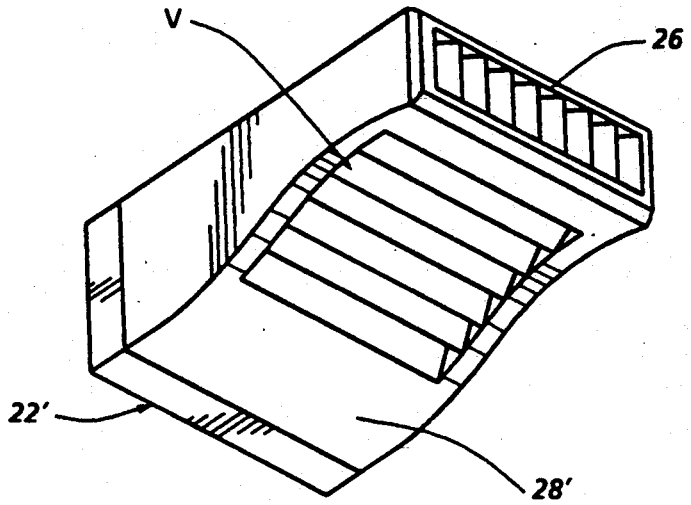
FIG. 5 is a bottom perspective view of a second form of the duct element of the present invention.

A second form of the duct element is shown at 20' in FIG. 5. The duct element 20' is designed in a manner identical to the element 20, but differs in having an intake section 22' in line with the exhaust section 26 thereof. The body 28' is similar to the body 28 in having a converging section between the intake section and the exhaust section and a plurality of vents V that are sized in co-operation with the variation of the negative pressure gradient established in the element 28' as air flows therethrough.

Figure 6:
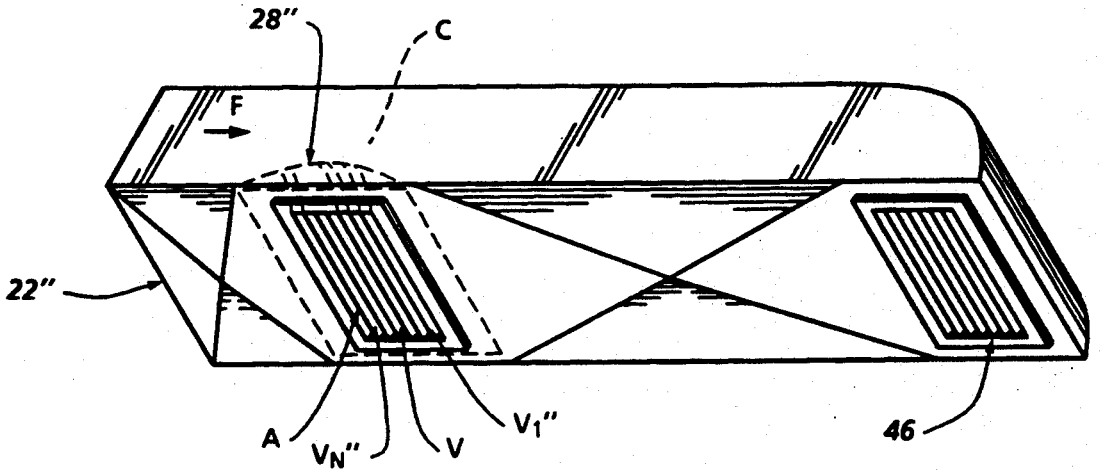
FIG. 6 is a bottom perspective view of a third form of the duct element of the present invention.

A third form of the duct element is shown in FIG. 6 as element 20''. The element 20'' includes vents intersecting curved bodies, such as arcuate body 28''. The curved body 28'' is similar to the curved bodies 28 and 28' in that a converging section C is defined with the remainder of the duct. The vents V'' have cross-sectional areas that vary in increasing size in flow direction F from intake 22''. The size variation of the vents V'' in the body 28'' is identical to the variation shown in FIGS. 3 and 4 whereby the cross-sectional area $A_{VN}''$ on the wall 28'' of vent $V_N''$ is the largest area and the cross-sectional area $A_{V1}''$ of vent $V_1'$ is the smallest cross-sectional area on the wall 28''. The vent section 46 is a normal vent. Room air will be drawn into the vents V as indicated by arrow A in FIG. 6 as the conditioned air flows past the arcuate wall 28 according to the negative pressure gradient relationships discussed above.

Figure 7:
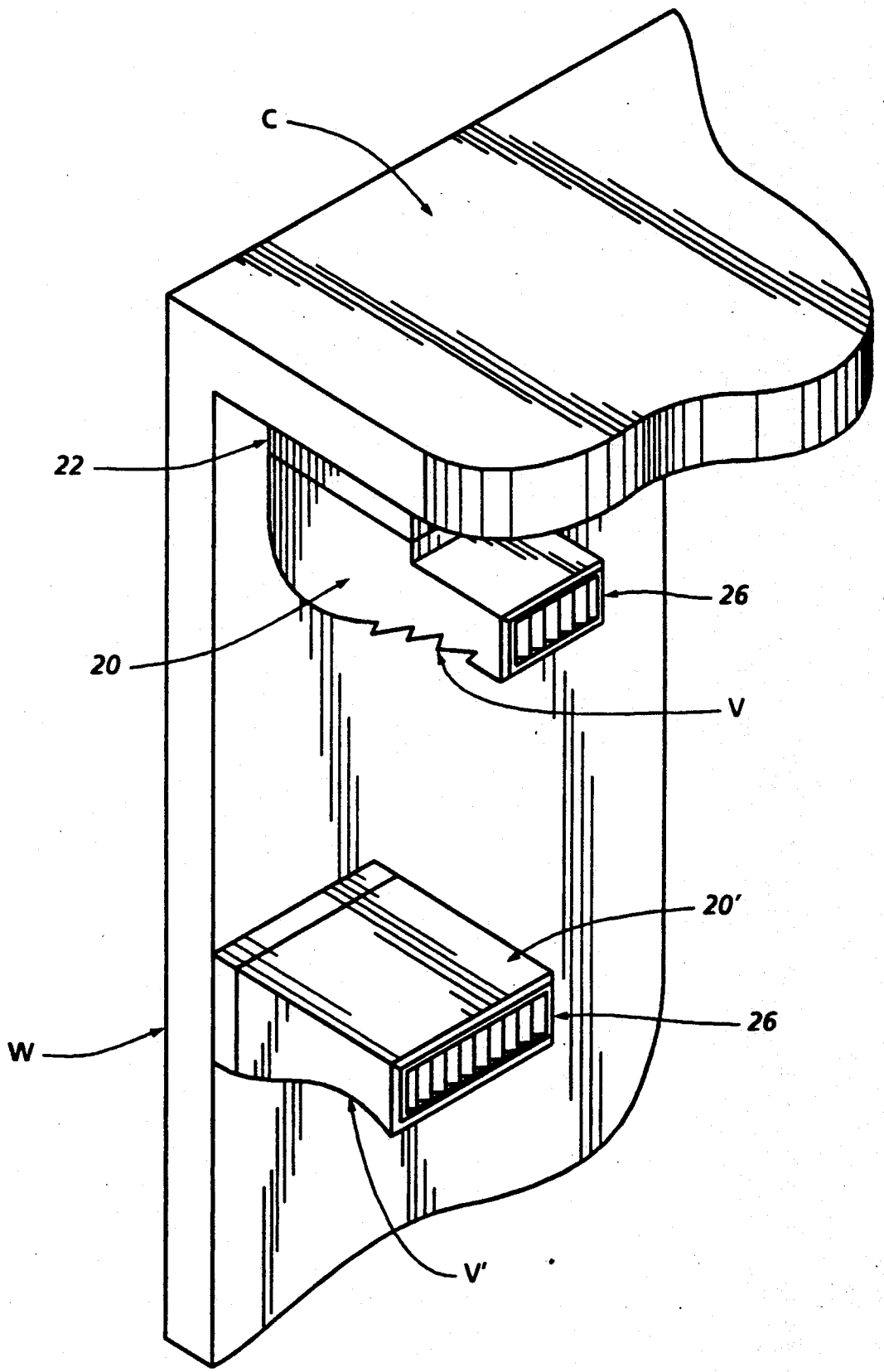
FIG. 7 is a perspective view showing the mounting of the first and second form of duct elements.

The first two forms of the duct element are shown in FIG. 7 in a mounted position on a ceiling C and a wall W respectively.

It is understood that while certain forms of the present invention have been illustrated and described herein, it is not to be limited to the specific forms or arrangements of parts described and shown.

I claim:

1. An element for use in a heating and air conditioning ductwork system comprising:

(A) an intake section having an intake cross-sectional area and being fluidically connected to a source of heated or cooled air;

(B) an exhaust section having an exhaust cross-sectional area that is less than said intake cross-sectional area;

(C) a body fluidically connecting said intake section, to said exhaust section, said body having an shaped portion and converging in cross-sectional area from said intake section to said exhaust section and forming a throat section adjacent to said exhaust section and converging to said throat section, air flow through said body being subsonic and establishing a negative pressure gradient that varies according to an area/pressure relationship of $(dA)/A=[V^2][1-M^2]$, where A=area; p=pressure; V=air flow velocity; and M=the mach number;

(D) a plurality of vents defined in said arcuate shaped portion of said body, each vent having a cross-sectional area that differs from the cross-sectional area of adjacent vents, said vent cross-sectional areas decreasing from said intake section to said exhaust section according to said/pressure relationship.

2. The element for use in a heating and air conditioning ductwork system defined in claim 1 further including adjustable louvers in said exhaust section.

3. The element for use in a heating and air conditioning ductwork system claim 2 further including a damper in said intake section.

4. The element for use in a heating and air conditioning ductwork system claim 3 further including a throat section located adjacent to said exhaust section.

* * * * *